US005727963A

United States Patent [19]

LeMaster

[11] Patent Number: 5,727,963

[45] Date of Patent: Mar. 17, 1998

[54] MODULAR POWER CONNECTOR ASSEMBLY

[76] Inventor: Dolan M. LeMaster, 3327 E. Desert Flower, Phoenix, Ariz. 85004

[21] Appl. No.: 641,490

[22] Filed: May 1, 1996

[51] Int. Cl.[6] ..... H01R 13/627

[52] U.S. Cl. ..... 439/358; 439/557

[58] Field of Search ..... 439/350, 357, 439/358, 557, 569, 678, 732

[56] References Cited

U.S. PATENT DOCUMENTS

| | | | |
|---|---|---|---|
| 4,718,857 | 1/1988 | Noschese | 439/358 X |
| 5,277,623 | 1/1994 | Colleran et al. | 439/557 |
| 5,378,168 | 1/1995 | Sumida | 439/358 |
| 5,382,177 | 1/1995 | Hutchinson, Jr. et al. | 439/358 |

*Primary Examiner*—Khiem Nguyen

*Attorney, Agent, or Firm*—Meschkow & Gresham, P.L.C.; Lowell W. Gresham; Jordan M. Meschkow

[57] ABSTRACT

A modular power connector includes male and female housings that releasably couple together. Each housing has ten apertures that locate conductive pin and socket elements. The apertures are arranged in a compact, asymmetrical, three-tier array that ensures that the connector is self-aligning. When the power connector is coupled together, a pin element and a socket element establish an initial ground connection before contact is established between the remaining pin and socket elements. The male housing includes a pair of holding tabs and the female housing includes a pair of cooperating lever arms that facilitate quick and easy connection and disconnection. A protective housing couples the female housing to a conduit and establishes an equipment ground connection between a ground wire and the conduit.

6 Claims, 6 Drawing Sheets

Flg. 2

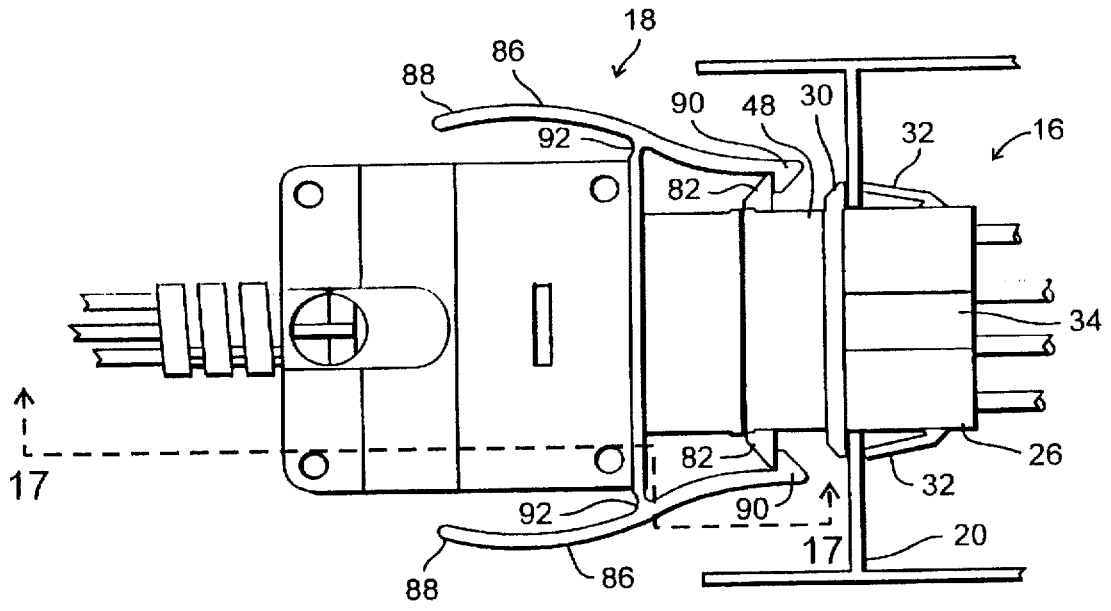
Fig. 3
Fig. 10
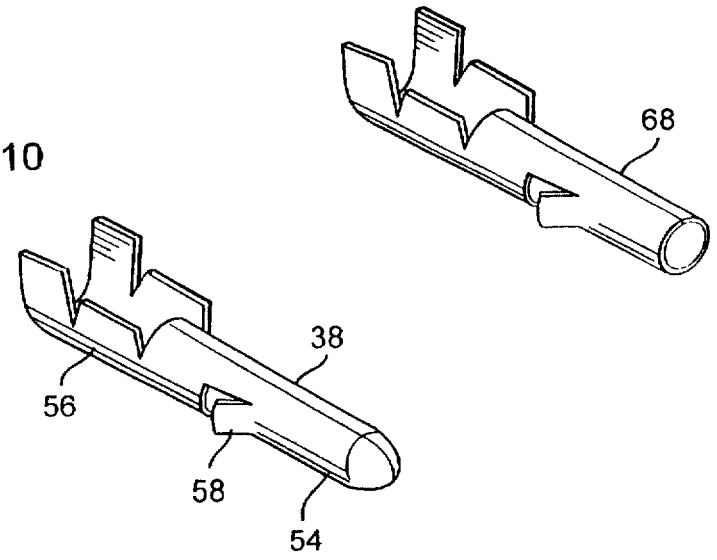

MODULAR POWER CONNECTOR ASSEMBLY

FIELD OF THE INVENTION

The present invention relates generally to electrical connectors. More specifically, the present invention relates to modular connectors for use with electrical power circuits.

BACKGROUND OF THE INVENTION

Electrical connectors are available in many configurations to suit a variety of applications. For example, electrical connectors may be employed in modular wall systems to interconnect power circuits and/or data communication cables. Eight-pin power connectors are commonly used in modular wall systems to provide electricity to junction boxes having a number of outlet sockets. Such eight-pin power connectors are designed to carry three separate power circuits (each circuit utilizing two pins) and two separate ground connections. Unfortunately, the electrical and/or physical requirements of some applications cannot be sufficiently satisfied by prior art eight-pin power connectors.

Some electronic components, such as computers and best equipment, may require isolated or dedicated power circuits to reduce the likelihood of electrical interference or to ensure that some components are provided with a "conditioned" power supply. As such, eight-pin power connectors may be rewired in a "custom" manner to increase the number of power circuits supported by the connectors. For example, an eight-pin connector can be reconfigured to provide more than three power circuits if a neutral pin is shared by multiple circuits rather than being devoted to a single circuit. While such a custom configuration may increase the circuit capacity of the connector, the connector may become overloaded by the increased power demand associated with certain operating conditions.

Some modular power connectors can be mated together regardless of whether the conductive pins are properly aligned. Inconsistent pin alignment between the mating halves of a "reversible" power connector can cause short circuits, system failures, and serious human injury. Consequently, installers of electrical circuits that utilize such connectors must take precautionary measures to ensure that the connectors are properly aligned. These precautionary measures increase the time and cost associated with the installation and maintenance of power circuits that employ reversible power connectors.

Prior art power connectors may be configured such that the various electrical contacts are simultaneously established as the connector is coupled together. Unfortunately, connectors that simultaneously establish connections to all circuits do not provide an initial ground connection during installation. Such a ground connection may be desirable if, for example, the power circuits are active when a connector is mated and internal short circuits are present within the connector assembly. In such a situation, a previously established ground can protect the cabling technician and/or any electronic equipment that may be coupled to the associated power circuits.

The connector size and layout of wires within the connector should be considered where more than eight wires are utilized. Although eight-pin connectors are often arranged in a symmetrical two-by-four array, a two-tier array may be undesirable for use with ten or more pins. For example, it may be difficult to feed the electrical wires from a wide connector into a rigid conduit that tightly groups the electrical wires together. In addition, a relatively flat and wide connector may be more expensive to manufacture than a relatively compact connector having the same number of connector pins. Furthermore, a wide connector assembly may be difficult to manipulate, orient, and install in a relatively confined environment.

SUMMARY OF THE INVENTION

Accordingly, it is an advantage of the present invention that an improved modular power connector is provided.

Another advantage of the present invention is that a ten-pin power connector is provided that is capable of supplying up to four isolated power circuits and two ground connections.

Another advantage is that the power connector has an asymmetrical pin arrangement to ensure that the pins are properly aligned when the connector is mated.

A further advantage of the present invention is that it provides a power connector that initially establishes a ground connection when the connector is mated.

Another advantage is that the present invention provides a ten-pin connector having three tiers of pins asymmetrically and compactly arranged.

The above and other advantages of the present invention are carried out in one form by a modular power connector assembly having male and female housings that releasably couple together. The female housing has more than eight apertures and a like number of conductive socket elements configured to fit within the apertures. The male housing has the same number of apertures and the same number of conductive pin elements configured to fit within the apertures. The pin elements engage with the socket elements and one of the socket and pin element pairs are the first to establish contact when the housings are coupled together.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 3 is a top view of male and female connector housings coupled together;

FIG. 10 shows perspective views of conductive pin and socket elements;

DETAILED DESCRIPTION OF THE PREFERRED EMBODIMENT

Figure 1:
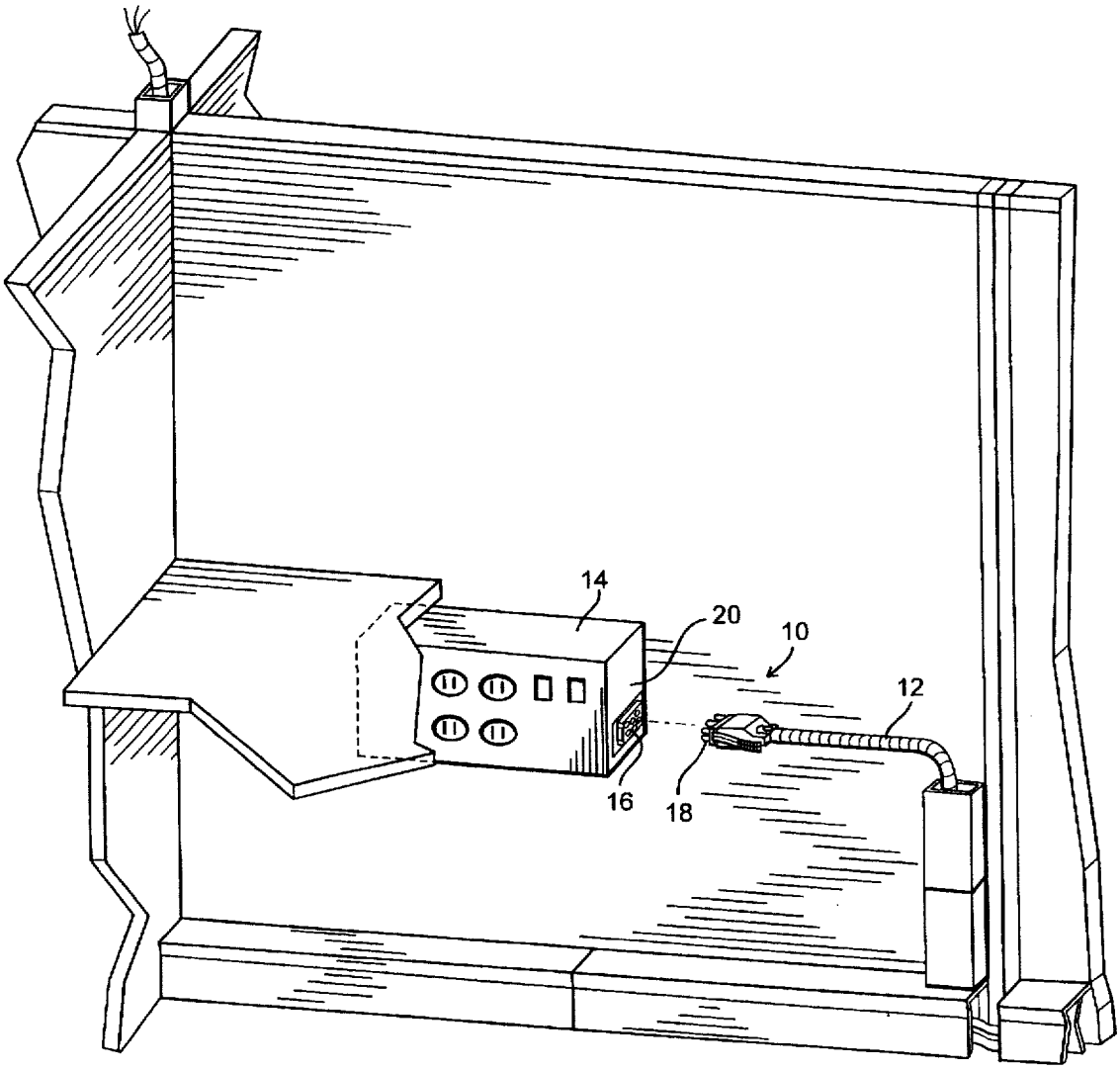
FIG. 1 shows an exemplary environment in which a modular connector assembly may be utilized.

FIG. 1 illustrates a typical environment in which a modular connector assembly 10 may be employed. Connector assembly 10 is preferably utilized to establish electrical connections for a number of power circuits. For example, connector assembly 10 may serve to connect a power whip 12 to a junction terminal 14. Wires may be routed within junction terminal 14 and connected to outlet jacks, switches, or other components. Connector assembly generally includes a male housing 16 and a female housing 18 configured to releasably couple together. Male housing 16 is preferably mounted to a support structure such as a firewall 20, and female housing 18 may be coupled to the end of power whip 12.

In the context of this description, "male" refers to the male conductive pins (not shown in FIG. 1) carried within male housing 16 and "female" refers to the female conductive sockets (not shown) carried within female housing 18. The conductive pins and sockets are described below.

Figure 2:
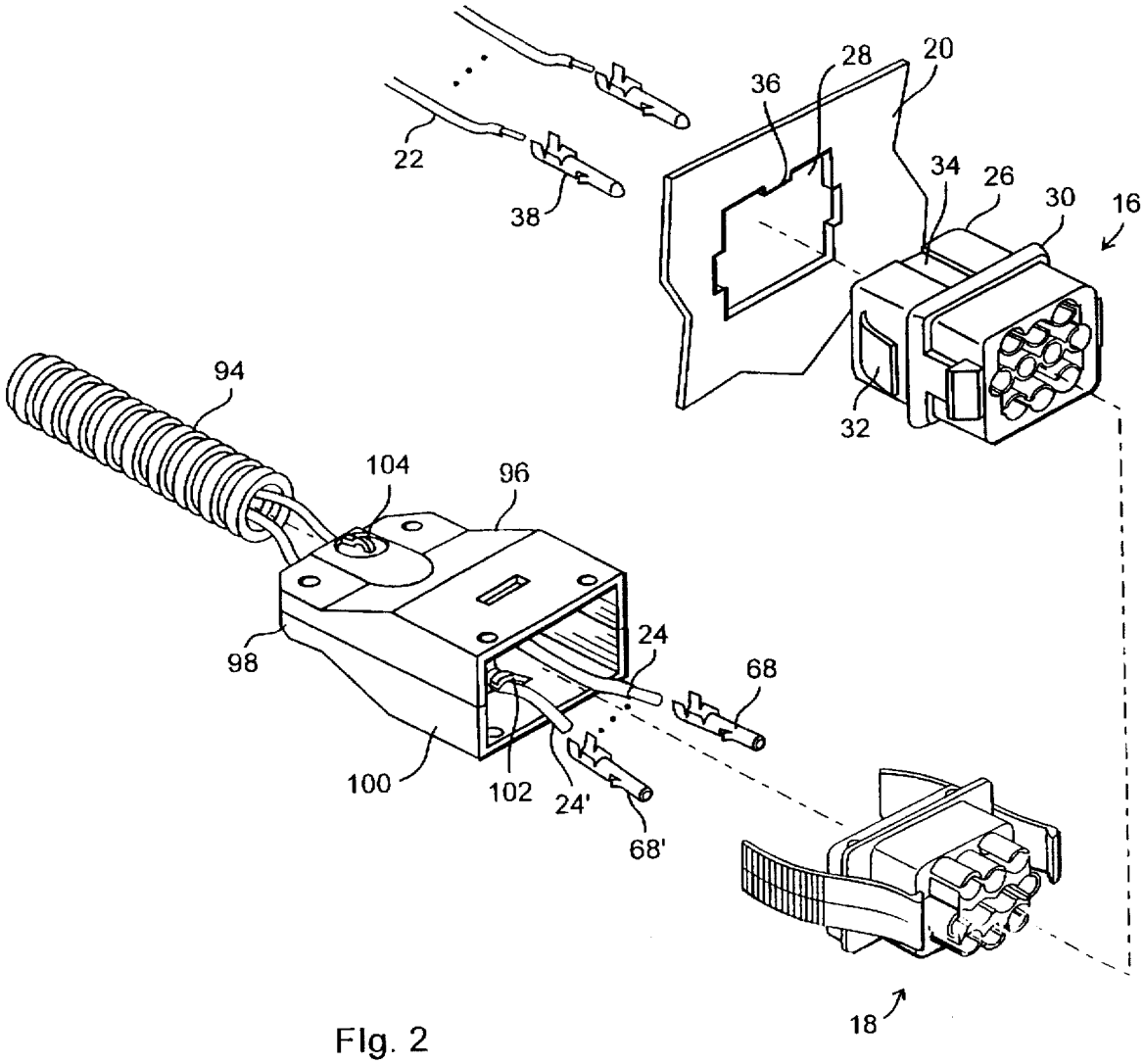
FIG. 2 is an exploded perspective view of the modular connector assembly.
Figure 4:
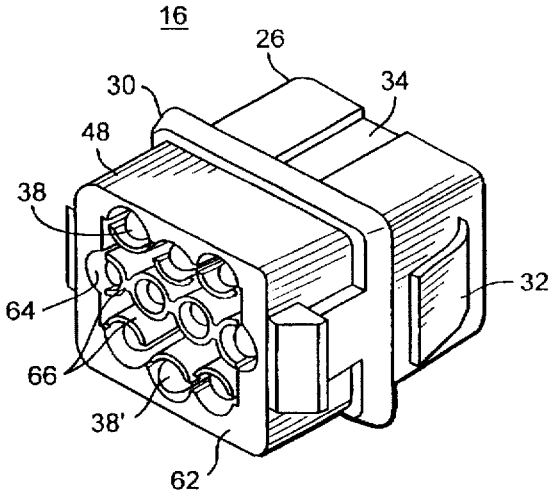
FIG. 4 is a perspective view of a male connector housing.

An exploded perspective view of connector assembly 10 is illustrated in FIG. 2. When coupled together, male and female housings 16 and 18 provide electrical contact between a first group of wires 22 and a second group of wires 24. FIG. 3 shows male and female housings 16 and 18 coupled together with male housing 16 installed within firewall 20. Male and female housings 16 and 18 are preferably formed from an electrically insulating material such as molded nylon. Although connector assembly 10 is desirably capable of interconnecting up to ten pairs of wires, only two pairs are shown for illustrative purposes. Ten wires are preferably configured to provide four isolated power circuits (each circuit utilizing a live wire and a corresponding neutral wire) and two separate ground connections.

Referring to FIGS. 4–9, male housing 16 is shown in a number of views. In the preferred embodiment, male housing 16 is configured to be releasably coupled to firewall 20. As shown in FIGS. 2–3, a rear portion 26 of male housing 16 is received in a mounting hole 28 formed within firewall 20. A lip 30 located on male housing 16 prevents male housing 16 from completely passing through mounting hole 28. A pair of flexible tabs 32, attached to the rear portion 26, are configured to expand outwardly after passing through mounting hole 28. The expansion of flexible tabs 32 secures male housing 16 within firewall 20. A technician can remove male housing 16 from firewall 20 by urging flexible tabs 32 inward such that they can pass through mounting hole 28.

Rear portion 26 of male housing 16 may also include an alignment slot 34 formed therein. Alignment slot 34 is sized to engage with a key 36 formed within firewall 20. As shown in FIG. 2, mounting hole 28 generally conforms to the shape of male housing 16 to receive rear portion 26, flexible tabs 32, and alignment slot 34. Alignment slot 34 and key 36 cooperate to align male housing 16 in a predetermined orientation relative to mounting hole 28. Alignment slot 34 and key 36 are desirable to ensure that connector assembly 10 can be installed quickly and to ensure that multiple connector assemblies 10 can be consistently oriented in a particular application.

To accommodate ten wires 22 (see FIG. 2), male housing 16 is configured to receive and locate ten conductive pin elements 38. A perspective view of one pin element 38 is shown in FIG. 10. In accordance with conventional practices, the ends of wires 22 are stripped and pin elements 38 are crimped onto the stripped ends of wires 22. Pin elements 38 may be scored to improve the crimped electrical connection. Other techniques, such as soldering, can be employed to produce an equivalent physical and electrical connection between wires 24 and pin elements 38. After crimping or soldering, pin elements 38 are inserted into a corresponding number of apertures 40 (see FIGS. 5, 6, and 9) formed within male housing 16.

Figure 5:
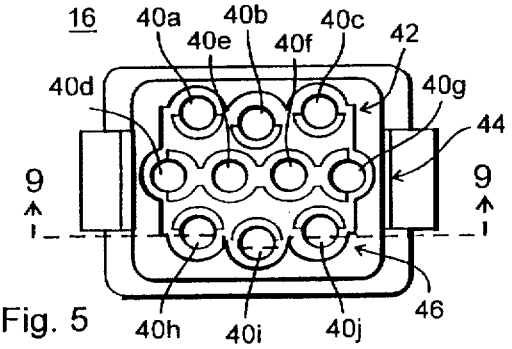
FIG. 5 is a front view of the male connector housing.
Figure 7:
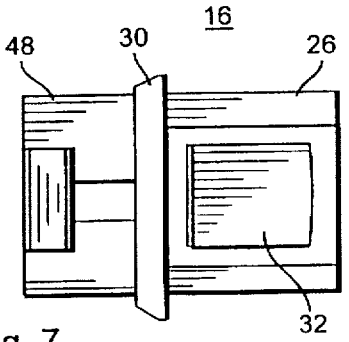
FIG. 7 is a side view of the male connector housing.
Figure 6:
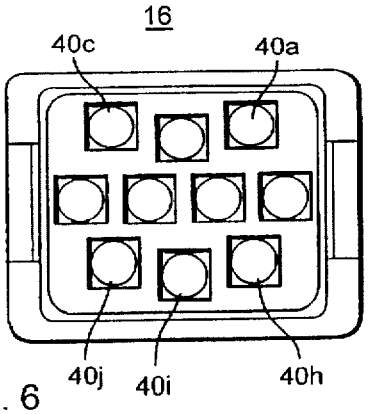
FIG. 6 is a rear view of the male connector housing.
Figure 8:
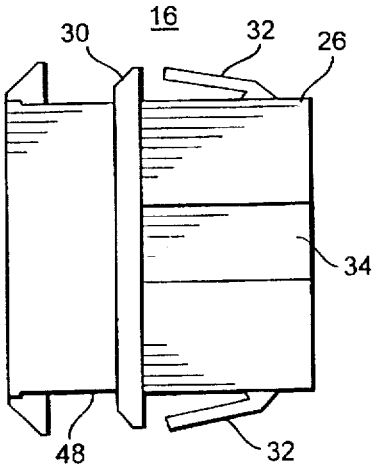
FIG. 8 is a top view of the male connector housing.

As best shown in FIG. 5, apertures 40 are preferably configured in an asymmetrical three-tier array. The asymmetrical configuration prevents connector assembly 10 from being incorrectly coupled together and ensures that the proper electrical circuits are formed. The array includes an upper tier 42 of three apertures **40*a*, 40*b*, and 40*c*, a middle tier 44 of four apertures 40*d*, 40*e*, 40*f*, and 40*g*, and a lower tier 46 of three apertures 40*h*, 40*i*, and 40*j***. The terms upper and lower are merely used herein to maintain consistency with the figures, and are not intended to impose limitations on the present invention.

In the preferred embodiment, apertures **40*d*, 40*e*, 40*f*, and 40*g* in middle tier 44 are substantially aligned with one another, i.e., the longitudinal axes of apertures 40*d*, 40*e*, 40*f*, and 40*g* are approximately coplanar. In contrast, aperture 40*b* in upper tier 42 is relatively offset from apertures 40*a* and 40*c* in upper tier 42. Similarly, aperture 40*i* in lower tier 46 is relatively offset from apertures 40*h* and 40*j* in lower tier 46. The offset nature of apertures 40*b* and 40*i*** creates the asymmetry in the array.

In the preferred embodiment, four live, four neutral, and two ground wires are individually coupled to a corresponding pin element 38. The pin elements 38 are subsequently placed in specific locations within male housing 16. In a preferred wiring layout, the four live wires are coupled to pin elements 38 located in middle tier 44. Specifically, first, second, third, and fourth live wires are associated with apertures **40*g*, 40*f*, 40*e*, and 40*d*, respectively. Corresponding first, second, third, and fourth neutral wires are associated with apertures 40*j*, 40*c*, 40*a*, and 40*h*, respectively. First and second ground wires are associated with apertures 40*b* and 40*i* (the offset apertures in upper tier 42 and lower tier 46, respectively). Those skilled in the art will recognize that alternative wiring arrangements may be implemented with connector assembly 10**. The specific wiring arrangement may be selected to minimize electrical interference between power circuits, to meet electrical standards, or to reduce the likelihood of short circuiting.

Figure 9:
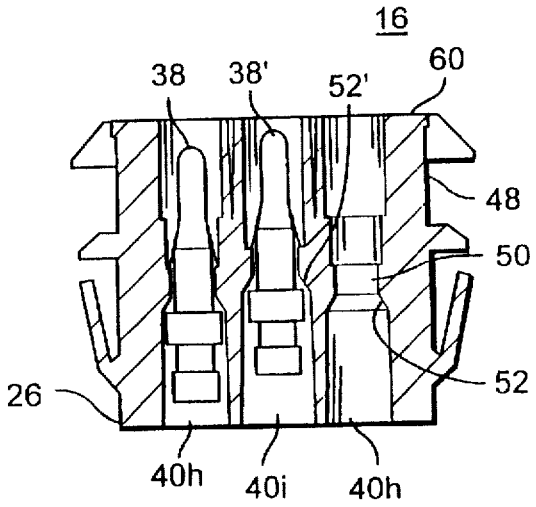
FIG. 9 is a cross sectional top view of the male connector housing as viewed from line 9—9 in FIG. 5.

FIG. 9 is a cross sectional top view of male housing 16 as viewed from line 9—9 in FIG. 5. Line 9—9 intersects the longitudinal axes of apertures **40*h*, 40*i*, and 40*j* (located in lower tier 46). Apertures 40 are substantially identical in size and shape, and are configured to accommodate pin elements Apertures 40 have a substantially square cross section (see FIG. 6) proximate rear portion 26 of male housing 16 and a substantially circular cross section (see FIG. 5) proximate a front portion 48 of male housing 16. The square cross section of apertures 40 accommodates the crimped portion of pin elements 38**.

Each aperture 40 is formed to define a neck region 50 and a retaining shoulder 52 adapted to position pin element 38 within male housing 16. With reference to FIG. 10, a front segment 54 of pin element 38 is sized to pass through neck region 50 and a rear segment 56 of pin element 38 is sized such that retaining shoulder 52 prevents pin element 38 from completely passing through neck region 50. Pin element 38 includes a plurality of fins 58 formed near front segment 54. Fins 58 are configured to contract when front segment 54 is inserted through neck region 50 and to subsequently expand to prevent removal of pin element 38 through neck region 50.

Connector assembly 10 is adapted such that an equipment ground connection is initially established when male and female housings 16 and 18 are coupled together. To realize this feature, a pin element 38' associated with the equipment ground wire is located within male housing 16 such that it extends further toward front portion 48 of male housing 16 than the remaining pin elements 38. In the preferred embodiment, pin element 38' is located in aperture **40*i***.

In the preferred embodiment, retaining shoulder 52' associated with pin element 38' is located at a first depth measured perpendicularly from a front surface 60 of male housing 16 and the remaining retaining shoulders 52 are located at approximately a second depth measured from front surface 60. The second depth is greater than the first depth, i.e., pin element 38' is forwardly displaced within male housing 16 relative to the remaining pin elements Male housing 16 includes a collar 62 (see FIG. 4) having an inner surface 64 that is asymmetrically shaped to accommodate a similarly shaped portion of female housing 18 (described below). Collar 62 substantially surrounds pin elements 38 and inner surface 64 generally follows the outline pattern formed by the array of apertures 40. Collar 62 ensures that pin elements 38 are not touched or damaged by foreign objects. Male housing 16 may also include a number of raised partitions 66 positioned around pin elements 38. Raised partitions 66 ensure that pin elements 38 do not contact one another after connector assembly 10 is assembled.

With reference to FIGS. 11–16, female housing 18 is illustrated in a number of views. Female housing 18 is preferably attached to the free end of power whip 12 (see FIGS. 1–2). Female housing 18 is configured to receive and locate ten conductive socket elements 68 (see FIG. 10). As described above in connection with pin elements 38, wires 24 are stripped, socket elements 68 are preferably crimped onto the stripped ends of wires 24, and socket elements 68 are inserted into a corresponding number of apertures 70 formed within female housing 18 (see FIGS. 12–13).

Apertures 70 are also configured in the asymmetrical three-tier array described above. Male and female housings 16 and 18 are adapted such that apertures 40 substantially align with apertures 70 when connector assembly 10 is coupled together. The specific wiring layout described above is also utilized in female housing 18 such that proper power circuit and ground connections are established when connector assembly 10 is mated together (each socket element 68 in female housing 18 engages with a corresponding pin element 38 in male housing 16).

Figure 16:
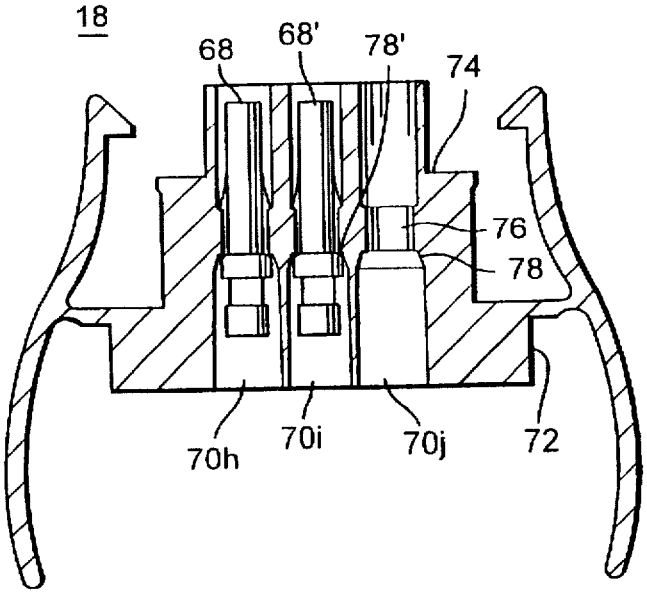
FIG. 16 is a cross sectional top view of the female connector housing as viewed from line 16—16 in FIG. 12.
Figure 12:
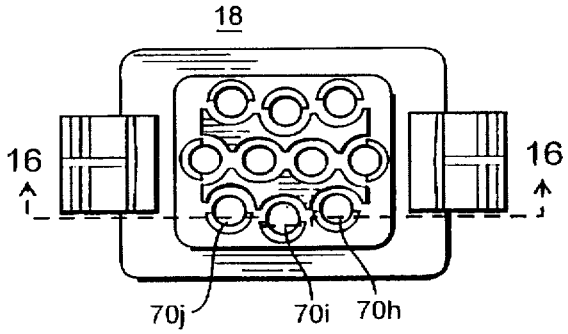
FIG. 12 is a front view of the female connector housing.
Figure 13:
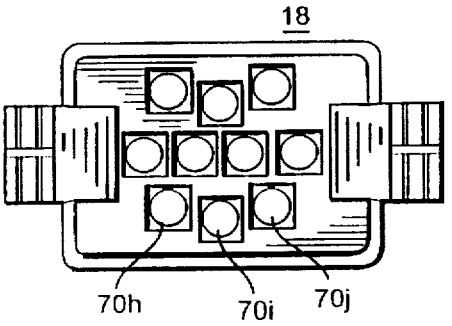
FIG. 13 is a rear view of the female connector housing.
Figure 15:
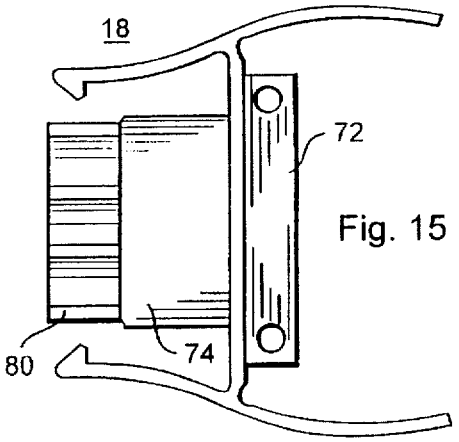
FIG. 15 is a top view of the female connector housing.
Figure 14:
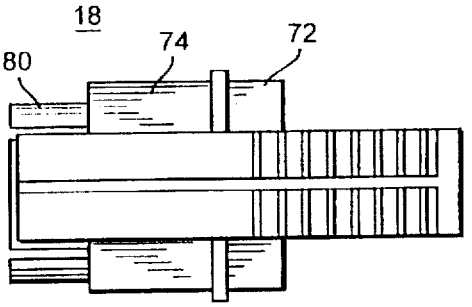
FIG. 14 is a side view of the female connector housing.

FIG. 16 is a cross sectional top view of female housing 18 as viewed from line 16—16 in FIG. 12. Line 16—16 intersects the longitudinal axes of apertures **70*h*, 70*i*, and 70*j*. Apertures 70 are substantially identical in size and shape, and are configured to accommodate socket elements 68. As with apertures 40 formed within male housing 16, each of apertures 70 has a substantially square cross section (see FIG. 13) proximate a rear portion 72 of female housing 18 and a substantially circular cross section (see FIG. 12) proximate a front portion 74 of female housing 18. In addition, each aperture 70 defines a neck region 76 and a retaining shoulder 78 that function to position socket elements 68 within female housing 18 in the manner described above with respect to pin elements 38. With respect to the initial ground connection established by pin element 38', retaining shoulder 78' associated with aperture 70*i* need not be displaced relative to the remaining retaining shoulders 78 in female housing Female housing 18 includes a plurality of raised partitions 80 arranged in an asymmetrical pattern around apertures 70 (see FIG. 11). Raised partitions 80 are configured such that a portion of each socket element 68 extends between adjacent raised partitions 80. Raised partitions 80 ensure that socket elements 68 do not contact each other and are not touched or damaged by foreign objects during handling of female housing 18. Raised partitions 80 are arranged such that they fit within collar 62 of male housing 16 (see FIG. 4). Raised partitions 80 generally define an outline that corresponds to inner surface 64 of collar 62. Raised partitions 80 and collar 62 facilitate consistent alignment between apertures 40 and 70 and consistent engagement between pin and socket elements 38 and 68 when male and female housings 16 and 18** are coupled together.

FIG. 3 shows a top view of male and female housings 16 and 18 coupled together. A pair of holding tabs 82 are formed in front portion 48 of male housing 16. Holding tabs 82 are each tapered in an outward direction toward rear portion 26 of male housing 16. Female housing 18 preferably includes a pair of lever arms 86 that cooperate with and releasably engage holding tabs 82 when first and second housings 16 and 18 are coupled together. Each lever arm 86 has an actuating end 88, a holding tip 90, and a fulcrum point 92 attached to rear portion 72 of female housing 18. Fulcrum point 92 is located between actuating end 88 and holding tip 90. Lever arms 86 are preferably shaped such that the distance between actuating ends 88 is greater than the distance between holding tips 90. This configuration allows female housing 18 to be quickly and easily disconnected from male housing 16.

Holding tips 90 are each tapered in an inward direction toward rear portion 72 of female housing. The outward taper of holding tabs 82 and the inward taper of holding tips 90 enables holding tips 90 to outwardly deflect to receive holding tabs 82 when male and female housing 16 and 18 are mated together. When removing female housing 18 from male housing 16, inward pressure applied to actuating ends 88 causes lever arms 86 to pivot about fulcrum points 92 such that holding tips 90 deflect in an outward manner. Female housing 18 can be separated from male housing 16 when holding tips 90 disengage holding tabs 82.

Figure 17:
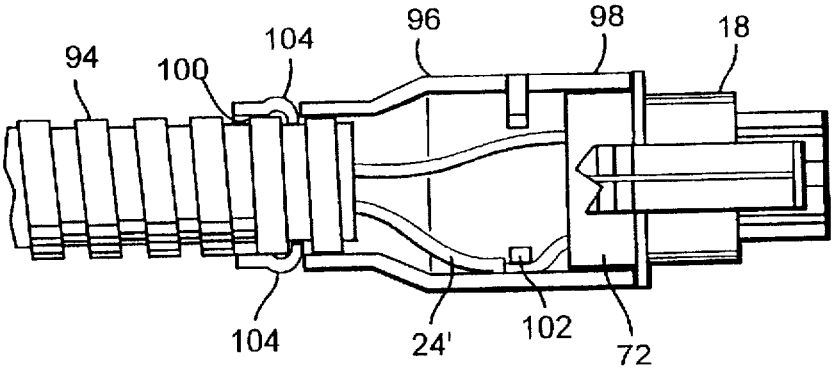
FIG. 17 is a cross sectional side view of a portion of the modular connector assembly as viewed from line 17—17 in FIG. 3.
Figure 11:
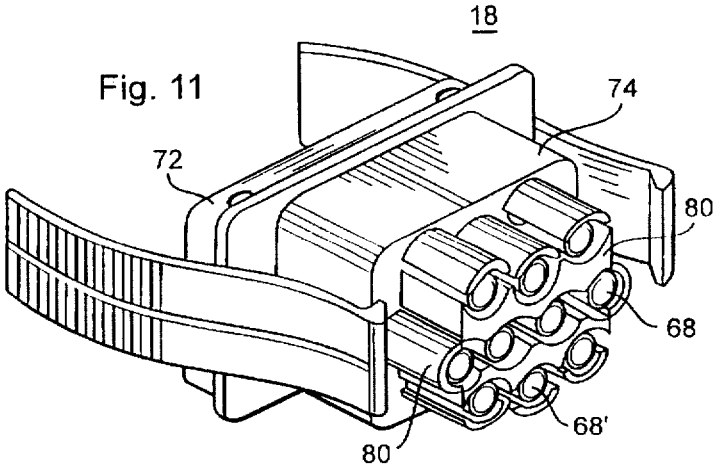
FIG. 11 is a perspective view of a female connector housing.

FIG. 17 shows a cross sectional side view of female housing 18 as viewed from line 17—17 in FIG. 3. FIG. 17 shows female housing 18 installed on the end of a conduit 94. In accordance with conventional practices, conduit 94 is a flexible aluminum tube through which wires 24 are fed. A protective shroud 96 has a first end 98 attached to rear portion 72 of female housing 18 and a second end 700 configured to receive conduit 94. Protective shroud 96 shields wires 24 as they transition from conduit 94 to female housing 18 and facilitates easy manipulation of female housing 18 during insertion into and removal from male housing 16.

Protective shroud 96 is preferably formed from an electrically conductive material such as aluminum. In the preferred embodiment, protective shroud 96 is formed from two similar halves that are sandwiched together. The use of similar components reduces the manufacturing and assembly costs associated with connector assembly 10.

Protective shroud 96 includes a crimp tab 102 for establishing an equipment ground connection. An equipment ground wire 24' is stripped and secured to protective shroud 96 via crimp tab 102. FIG. 2 also shows equipment ground wire 24' secured by crimp tab 102. In practice, equipment ground wire 24' is preferably crimped to protective shroud 96 after the associated socket element 68' is inserted into female housing 18 (see FIG. 16). Protective shroud 96 also includes two arcuate tabs 104 located proximate second end 100 of protective shroud 96. Arcuate tabs 104 are configured to establish an electrical contact between protective shroud 96 and conduit 94. In addition, arcuate tabs 104 function to physically secure conduit 94 to protective shroud 96.

During assembly of connector assembly 10, conduit 94 is located within protective shroud 96 and arcuate tabs 104 are bent to engage conduit 94. The curvature of arcuate tabs 104 facilitates alignment with the "valleys" typically formed in conventional aluminum conduit. Thus, arcuate tabs 104 and conduit 94 can be manipulated during assembly to compensate for the pitch often found in conventional aluminum conduit. Arcuate tabs 104 preferably engage conduit 94 such that conduit 94 is sufficiently grounded via equipment ground wire 24' The sandwich configuration of protective housing 96 may also reinforce the physical and electrical connection between protective housing 96 and conduit 94.

In summary, the present invention provides an improved modular power connector having a ten-pin arrangement that is capable of supplying up to four isolated power circuits and two ground connections. The power connector has an asymmetrical pin arrangement to ensure that the pins are properly aligned when the connector is mated. The ten pins are compactly arranged in three tiers. The power connector also includes a first-to-engage pin that initially establishes a ground connection when the connector is mated.

The above description is of a preferred embodiment of the present invention, and the invention is not limited to the specific embodiment described and illustrated. For example, the specific aperture arrangements shown and described is one of many that can be equivalently used in the power connector. In addition, nothing requires the power connector to specifically provide four power circuits and two grounds, and the power connector may be alternatively wired to suit the particular application. Furthermore, many variations and modifications will be evident to those skilled in this art, and such variations and modifications are intended to be included within the spirit and scope of the invention, as expressed in the following claims.

What is claimed is:

1. A modular power connector assembly comprising:

first and second housings configured to releasably couple together;

N first apertures formed within said first housing, N being a number greater than eight;

N conductive first housing contacts configured to fit within said first apertures;

N second apertures formed within said second housing; and

N conductive second housing contacts configured to fit within said second apertures;

wherein each of said first housing contacts engage with corresponding ones of said second housing contacts when said first and second housings are coupled together; and a predetermined one of said first housing contacts and a predetermined one of said second housing contacts are the first to establish contact when said first and second housings are being coupled together.

2. A connector assembly according to claim 1, wherein said predetermined first housing contact is a pin element located within said first housing such that said pin element extends further toward a front portion of said first housing than the remaining ones of said first housing contacts.

3. A connector assembly according to claim 2, wherein:

said first apertures are formed to define a corresponding plurality of retaining shoulders adapted to position said first housing contacts within said second housing;

said retaining shoulder associated with said predetermined pin element is located at a first distance measured perpendicularly from said front surface; and the remaining ones of said retaining shoulders are located at approximately a second distance measured perpendicularly from said front surface, said second distance being less than said first distance.

4. A modular power connector assembly comprising:

a first housing and a second housing, said first and second housings being configured to releasably couple together;

ten conductive first housing contacts located within said first housing ten conductive second housing contacts located within said second housing, said first housing contacts and said second housing contacts being configured to establish electrical contact with one another when said first and second housings are coupled together;

a flexible conduit coupled to said first housing; and a protective shroud having a first end attached to a rear portion of said first housing and a second end configured to retain said conduit, said protective shroud including an conductive tab located proximate said second end for establishing an electrical contact between a predetermined one of said first housing contacts and said conduit, and said tab being configured to secure said conduit to said protective shroud.

5. A connector assembly according to claim 4, wherein:

first, second, third, and fourth second housing contacts are respectively coupled to first, second, third, and fourth live conductor wires;

fifth, sixth, seventh, and eighth second housing contacts are respectively coupled to first, second, third, and fourth neutral conductor wires; and ninth and tenth second housing contacts are respectively coupled to first and second ground conductor wires.

6. A connector assembly according to claim 5, wherein:

a pin element is located within said first housing such that said pin element extends further from a front portion of said first housing than the remaining ones of said first housing contacts; and said tenth second housing contact and said pin element are the first to establish contact when said first and second housings are coupled together.

* * * * *